US005865667A

United States Patent [19]

Rollier

[11] Patent Number: 5,865,667

[45] **Date of Patent: *Feb. 2, 1999**

[54] GRINDING MACHINE

[75] Inventor: Michel Rollier, Neuchatel, Switzerland

[73] Assignee: Rollomatic S.A., Le Landeron, Switzerland

[ * ] Notice: The term of this patent shall not extend beyond the expiration date of Pat. No. 5,667,432.

[21] Appl. No.: 918,857

[22] Filed: Aug. 26, 1997

Related U.S. Application Data

[63] Continuation of Ser. No. 651,415, May 22, 1996, Pat. No. 5,667,432.

[51] Int. Cl.[6] ..... B24B 49/00; B24B 51/00

[52] U.S. Cl. ..... 451/11; 451/242

[58] Field of Search ..... 451/242, 5, 8, 451/9, 10, 11, 14, 194, 209, 210, 245, 246, 249, 252, 408, 197

[56] References Cited

U.S. PATENT DOCUMENTS

| | | | |
|---|---|---|---|
| 2,017,875 | 10/1935 | Theler et al. | 451/209 |
| 2,127,210 | 8/1938 | Dunbar | 451/209 |
| 2,322,620 | 6/1943 | Ekholm | 451/242 |
| 2,764,801 | 10/1956 | Miller et al. | 451/408 |
| 4,570,387 | 2/1986 | Unno et al. | 451/5 |
| 4,926,603 | 5/1990 | Frost et al. | 451/11 |
| 5,667,432 | 9/1997 | Rollier | 451/242 |

*Primary Examiner*—Timothy V. Eley
*Assistant Examiner*—Derris H. Banks
*Attorney, Agent, or Firm*—McGlew and Tuttle

[57] ABSTRACT

The part (1) to be machined, which exhibits an axis of revolution (aa') is secured in a rotatable spindle (11) forming part of a headstock (10) movable in translation on the framework of the grinding machine according to a longitudinal axis (X) parallel to the axis of revolution (aa'). A support (16) fixed to the framework and in the immediate proximity of which is arranged a grindstone (18), serves as lateral support to a portion of the part (1) to be machined. Grinding of the part (1) by the grindstone (18) over an arbitrary length capable of exceeding 1000 times its diameter, is effected by displacing the headstock (10) by such length in the sense of the longitudinal axis (X).

4 Claims, 3 Drawing Sheets

GRINDING MACHINE

This is a continuation of application Ser. No. 08/651,415 filed May 22, 1996 now U.S. Pat. No. 5,667,432.

The present invention concerns a grinding machine for the machining of parts with a surface generated by rotation, in particular formed of hard material such as carbide, high-speed steels etc. More specifically, it concerns a machine permitting grinding parts of small diameter over a substantial length.

BACKGROUND OF THE INVENTION

In known grinding machines, the part to be machined is secured in a part carrying spindle in order to be driven in rotation around its axis of revolution, the spindle forming part of a head-stock which is fixed to the framework of the machine. On the framework is further arranged a movable slide runner including a grindstone. The slide runner can be displaced generally by means of a digital control arrangement along a longitudinal and a transversal axis respectively oriented parallel and perpendicularly to the axis of revolution of the part to be machined which is also the rotation axis of the spindle. The displacement of the slide runner along the transversal axis enables bringing the grindstone, the axis of rotation of which is normally parallel to that of the spindle, into contact with the part to be machined in order to reduce its diameter to a desired value over a length corresponding to the longitudinal displacement of such slide runner. As is well understood, the two displacements of the slide runner can be programmed in a manner such that the piece exhibits a profile of predetermined form.

Such machines enable machining under good conditions of parts for which the ratio length-over-diameter, which ratio will be hereinafter designated by K, does not exceed approximately 10.

The grinding of parts exhibiting a ratio K greater than 10 is possible, but by means of so-called centerless machines, FIG. 1 shows the principal elements of such a machine seen in profile. The part to be machined 1 rests on a support 2 whilst being gripped by a roller 3 and a grindstone 4. As is well understood, the part includes a center, but the position of the center is not fixed since it depends on the diameter of the part, this particularity thus justifying the name given to such type of machine. The roller 3, the surface of which exhibits a high coefficient of friction, turns in the sense inverse to that of, the grindstone 4, such sense being chosen in a manner such that the roller and the grindstone urge the part 1 onto support 2. In such conditions, the roller drives the part 1 in rotation and renders possible its machining by the grindstone. Such machines enable machining cylindrical parts of about 1 millimeter diameter minimum over a length of several centimeters, which length is equal to the width of the grindstone. The corresponding ratio K can thus attain 100 at best.

The present invention proposes to provide a grinding machine having machining possibilities clearly more extensive, in particular far as concerns the ratio K, than the combined possibilities of existing machines.

SUMMARY OF THE INVENTION

To attain this objective, the grinding machine, according to the invention, for machining parts with a surface generated by rotation comprising a framework having arranged thereon, a headstock including a part carrying spindle, the spindle driving in rotation a part to be machined around its axis of revolution and a slide runner supporting a grindstone, is principally noteworthy in that it furthermore includes:

a support secured onto the framework and serving to support a portion of the part to be machined located outside the spindle, and means for displacing the headstock on the framework according to a longitudinal axis parallel to the axis of revolution, the grindstone being arranged close to the support and in contact with the part to be machined, in a manner to bring its diameter through abrasion to the desired value over a length equal to the displacement of the headstock.

Other characteristics and advantages of the grinding machine according to the invention will appear from the description which is to follow prepared with respect to the attached drawings and giving by way of explanation, but in no manner limiting, an example of an embodiment of such a machine. On the drawings, the same references refer to analogous elements throughout.

DESCRIPTION OF THE PREFERRED EMBODIMENTS

Figure 1:
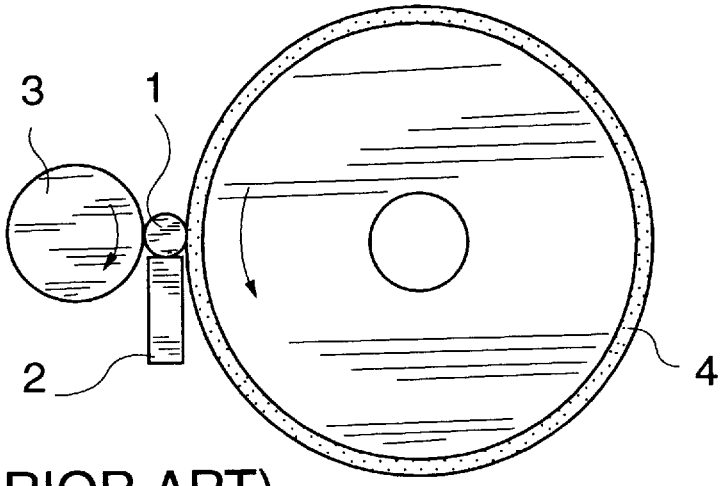
(PRIOR ART) FIG. 1
FIG. 1, already cited, is a schematic view showing in profile a so-called centerless grinding machine.
Figure 2:
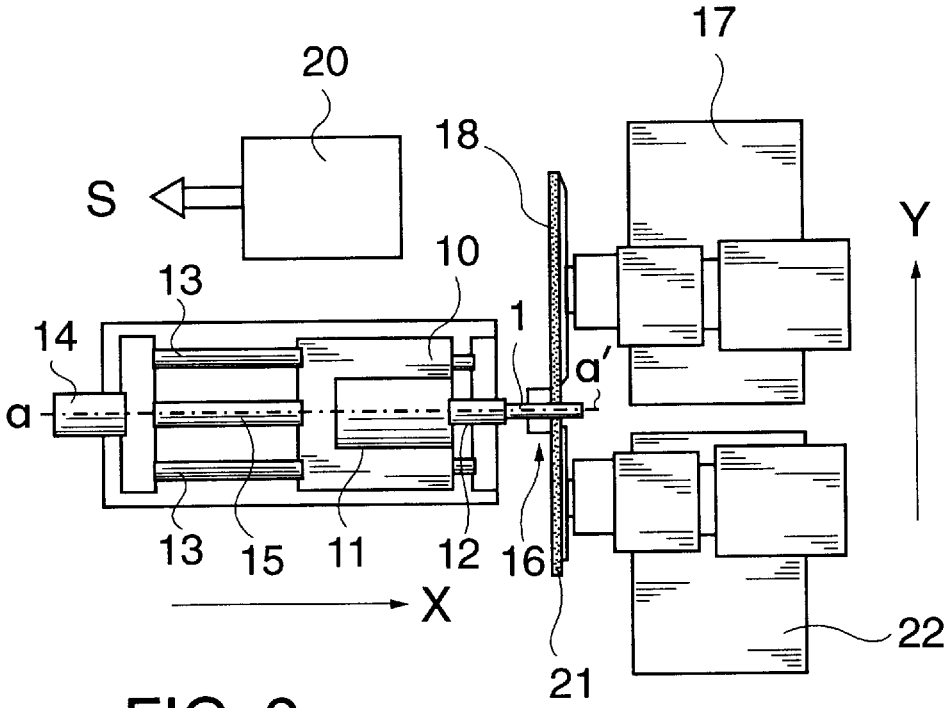
FIG. 2 is a plan view, a principal element of a grinding machine according to the invention.
Figure 6:
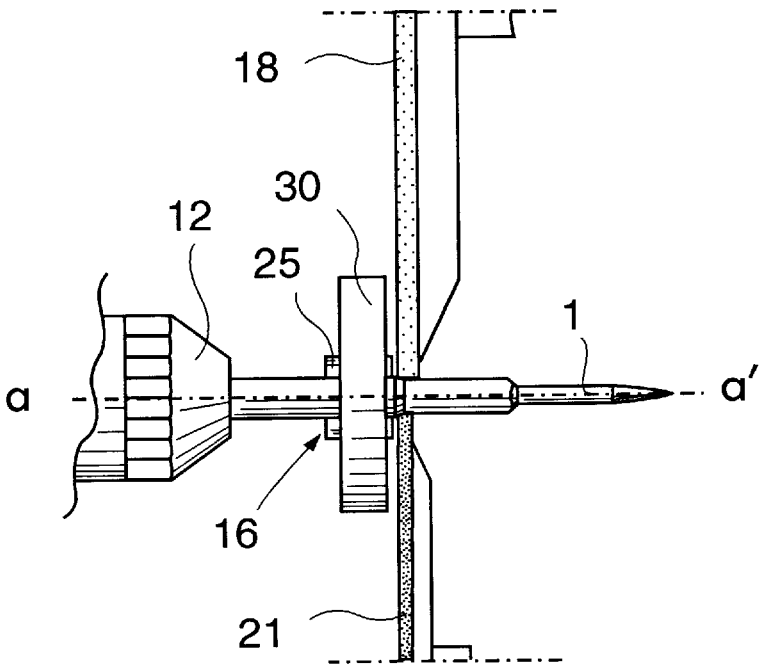
FIG. 6 is a plan view showing the arrangement of the grindstones relative to the part to be machined shown on FIG. 4 and an example of a ground part obtained by the machine according to the invention.

On FIG. 2, showing an embodiment of the grinding machine according to the invention, reference 10 designates a headstock which includes a part carrying spindle 11 serving to secure, for example by means of a chuck 12, the part to be machined 1, the form of which is that of a body of revolution. The spindle 11 drives part 1 in rotation around its axis of revolution aa' in order to permit its machining, as is shown in greater detail on FIG. 6.

Headstock 10 is arranged on the framework, not shown, of the grinding machine. While in conventional machines the headstock is rigidly secured onto the framework, in the present embodiment headstock 10 is movable in translation on the framework according to a longitudinal axis X parallel to the axis aa'. To this effect, the headstock has headstock feed means including slideways or rails 13 of the framework, the movement of translation being obtained by means of a motor 14 fixed to the framework and a transmission element 15, for example a lead screw arranged between the motor and the headstock.

A portion of the part to be machined 1 coming out of the chuck 12 bears against the support 16 rigidly secured onto the framework of the machine. Support 16, which will be described in detail hereinafter, serves to maintain such portion of part 1 in a well-defined position relative to the framework, whilst permitting it to rotate around axis aa'.

On the framework of the machine is further arranged a slide runner 17 which supports a grindstone 18 intended to machine part 1. The slide runner is movable in translation on the framework along a transversal axis Y, as in known machines, its displacement being obtained either manually or with the help of a motor, not shown. In the case of FIG. 2, axis Y and the rotation axis of the grindstone 18 are respectively oriented perpendicular and parallel to axis X, but different preferred orientations of such axes could also suit. In order to place the grindstone 18 in the position enabling machining of part 1 under optimum conditions, the slide runner 17 may further be displaced, for example manually, in the sense of axis X.

The operation of the grinding machine shown on FIG. 2 is as follows. Part 1, once secured in spindle 11, the headstock 10 is arranged on the rails or slideways 13 at a place which will permit it to be displaced in the direction of support 16 through a distance at least equal to the length which is to be ground. In this position of headstock 10, the free end of part 1 must be engaged in support 16 without going beyond it. The slide runner 17 is then displaced along axis X in a manner to bring the grindstone 18 as close as possible to a grinding side of support 16 without nevertheless touching it, then along axis Y in order to place the grindstone at a distance from axis aa' equal to the radius which the finished part must have. Following setting into rotation of part 1 and grindstone 18, the translation of headstock 10 towards support 16 can commence. The end of part 1 then enters into contact with grindstone 18 in order that the latter brings its diameter to a desired value by abrasion. Grindstone 18 being placed in the immediate neighborhood of support 16, the portion of part 1 which is subjected to the action of the tool exhibits a very small overhang. Bending of the part under these conditions is negligible, which guarantees a high precision of machining over a length, which in principle is arbitrary, equal to the displacement of the headstock. As is well understood, if the diameter of part 1 is very small and its length substantial, its machined end must be guided by introducing it for example into a tube, not shown.

With the grinding machine which has just been described, it has been possible to obtain, without any special difficulty, cylindrical parts of 0.05 mm diameter over a length of 50 mm with a tolerance of the diameter on the order of a micron. The ratio K, previously defined, of the length over the diameter is then in this case equal to 1000, that is to say ten times better than a machine of the centerless type can obtain.

In order to extend the machining possibilities of the machine as described, it can advantageously further include a digital control apparatus 20 which is programmable and which furnishes a multiple control signal S. This apparatus will not be described since such digital controls are known in themselves. The control signal S acts through electrical connections, not shown, on motor 14 and on the motor of the slide runner 17 which drives the latter parallel to the Y axis. In these conditions, the headstock 10 and the slide runner 17 can be displaced respectively along axes X and Y by the control apparatus 20 and such apparatus can be programmed in order that part 1 be machined in a fashion such that its diameter varies at least over a portion of length according to a predetermined principle. An example of a part thus machined is shown on FIG. 6. The machine can also include another grindstone 21 arranged on another slide runner 22. Such slide runner, similar to slide runner 17, is movable along axes X and Y, the displacement according to axis Y being preferably obtained by means of a motor, not shown, receiving the control signal S. Grindstone 18 can be a rough grinder and grindstone 21 a finish grinder. This latter grindstone must then be placed at a distance slightly greater from support 16 than grindstone 18 and the program of the control apparatus 20 take such separation into account. The utilisation of two grindstones enables increasing the rapidity of machining and improves the state of the machined surface.

Figure 3A:
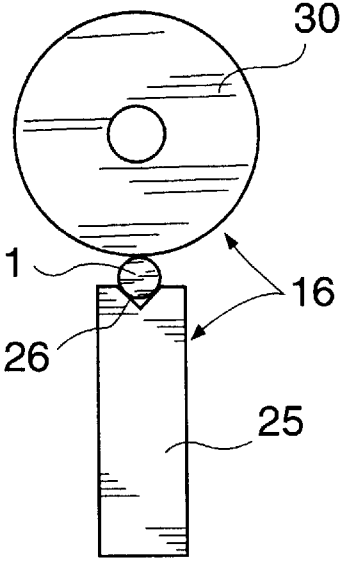
FIGS. 3*a* and 3*b* are shows an embodiment of the support serving to bear the part to be machined.
Figure 3B:
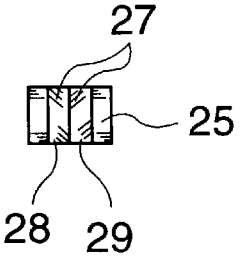

Support 16, one embodiment of which is shown in FIGS. 3*a* and 3*b*, is an essential element of the grinding machine according to the invention. Reference 25 designates, on such figures, a sustaining foot rigidly secured onto the framework of the machine, such foot being shown in profile on FIG. 3*a* and in plan on FIG. 3*b*. The free portion of the foot exhibits a notch 26 in V form in which is positioned the part to be machined 1. The notch is bounded by a face 27 which includes, in the present case, two planar faces 28 and 29 parallel to the axis of revolution aa' and forming between them an angle of about 90°. Face 27 serves to support part 1, the form of which before its machining is that of a cylinder of circular cross-section. In order to diminish the wear, the planar faces 28 and 29 are advantageously constituted by hard metal inserts. The part to be machined 1 is furthermore firmly held in notch 26 by a pressure roller 30. Such roller is movable in rotation around an axis parallel to axis aa' and it exerts a sufficient force, typically of 50 kg, on part 1 in order to prevent it from being radially displaced, whilst enabling it to rotate. Finally, support 16 is arranged on the framework of the machine in a manner such that the line joining the center of roller 30 to that of part 1 is a perpendicular straight line passing by the trace or line defined by the intersection of the planar faces 28 and 29 of notch 26.

Figure 5:
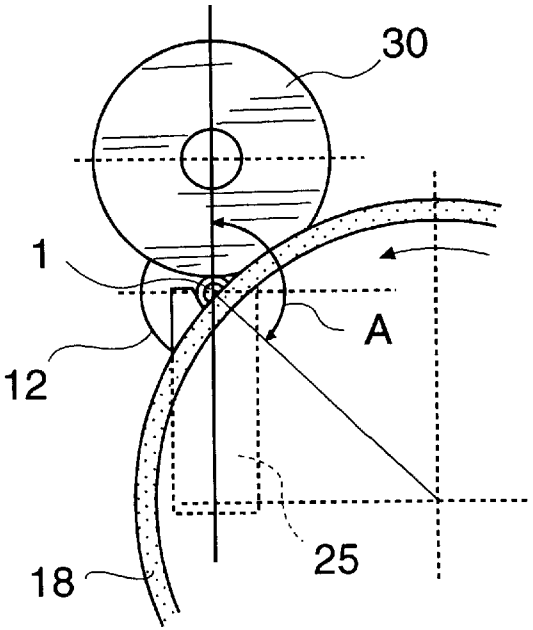
FIG. 5 is another possible arrangement of a grindstone relative to the part to be machined.
Figure 4:
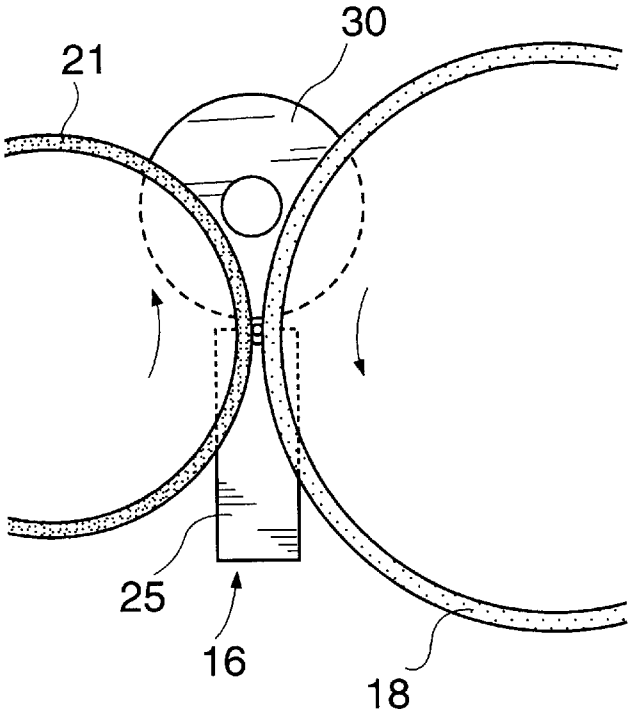
FIG. 4 is an end view showing a possible arrangement, relative to the part to be machined, of a stone for coarse grinding and of a stone for finish grinding

The relative positions of the part 1 to be machined, support 16 and the grindstones 18 and 21 are shown in a profile view on FIG. 4. In this arrangement which corresponds to that of FIGS. 2 and 6, the centers of the grindstones and the part to be machined are aligned on the same horizontal line. The grindstone 18 can advantageously be differently positioned as is shown on FIG. 5 in a manner such that the lines joining the center of the part to be machined 1 to the centers of the pressure roller 30 and grindstone 18 form an angle A of about 135°. The force which the grindstone 18 exerts on part 1 then resolves into two forces, one horizontal and the other vertical, passing through the center of roller 30. The horizontal force is weaker in this case than in that of FIG. 4, this bringing about a lesser lateral bending of foot 25 and thus an improved quality of machining.

Figure 7:
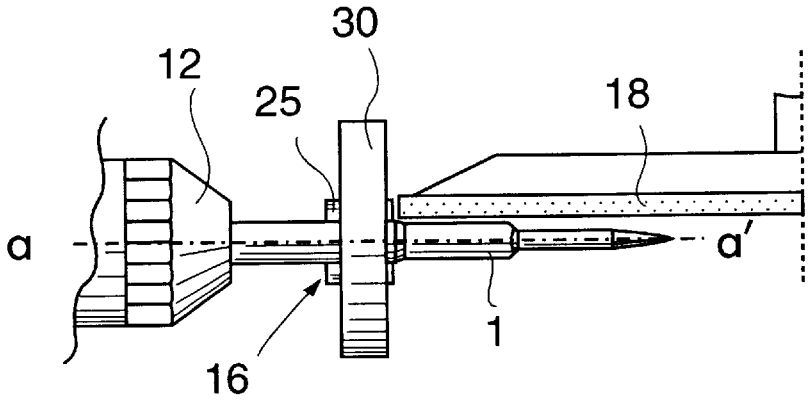
FIG. 7 is a plan view of yet another possible arrangement of a grindstone relative to the part to be machined.

In the examples which have just been described, the axes of rotation of grindstones 18 and 21 were parallel to the axis of revolution aa' of the part to be machined 1. Another orientation of the axis of the grindstone can, however, be employed. This is shown on FIG. 7 where the axis of grindstone 18 forms an angle slightly less than 90° relative to the axis aa'.

It is well understood that the grinding machine which has just been described can undergo still other modifications than those already mentioned and appear under other variants which are evident to the person skilled in the art, without departing from the framework of the present invention.

What I claim is:

1. A method for grinding, the method comprising the steps of:

grasping an end of a part to be ground in a spindle;

supporting the part in a support at a position spaced from said spindle;

rotating said spindle;

moving said spindle toward said support to cause portions of the part to extend away from said support in a direction substantially opposite from said spindle;

simultaneously grinding the portions of the part as they extend away from said support, by two grindstones engaging in a simultaneous manner on said portions, axis of rotation of said grindstones being substantially non parallel to a rotation axis of the

2. A grinding machine comprising:

a framework;

a head stock positioned on said framework, said head stock including a spindle means for holding a part to be machined, said spindle means also for rotating the part about a part rotation axis;

a support means positioned on said framework spaced from said head stock in a direction of said part rotation axis, said support means for supporting the part;

a grinding means positioned on a grinding side of said support means substantially opposite said head stock along said part rotation axis;

said grinding means including a grinding stone rotatable about a grinding axis, said grinding axis being substantially non parallel to said part rotation axis.

3. A grinding machine according to claim 2, further comprising:

second grinding means positioned on said grinding side of said support means, said first grinding means being positioned between said head stock and said second grinding means along said part rotation axis, said second grinding means including a second grinding stone rotatable about a second grinding axis, said second grinding axis being substantially non parallel to said part rotation axis and non parallel to the first grinding axis.

4. A grinding machine according to claim 3, wherein:

said first grinding stone is a coarse grinding stone and said second grinding stone is a fine grinding stone.

* * * * *